US006496147B1

(12) United States Patent
Kirino

(10) Patent No.: US 6,496,147 B1
(45) Date of Patent: Dec. 17, 2002

(54) ACTIVE PHASED ARRAY ANTENNA AND ANTENNA CONTROLLER

(75) Inventor: Hideki Kirino, Kagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/868,091

(22) PCT Filed: Dec. 14, 1999

(86) PCT No.: PCT/JP99/07004

§ 371 (c)(1),
(2), (4) Date: Aug. 23, 2001

(87) PCT Pub. No.: WO00/36702

PCT Pub. Date: Jun. 22, 2000

(30) Foreign Application Priority Data

Dec. 14, 1998 (JP) ..... 10-355121

(51) Int. Cl.[7] ..... H01Q 1/38; H01Q 1/00

(52) U.S. Cl. ..... 343/700 MS; 343/787; 333/156

(58) Field of Search ..... 343/700 MS, 778, 343/787, 853; 333/156, 161

(56) References Cited

U.S. PATENT DOCUMENTS

| | | | | | |
|---|---|---|---|---|---|
| 5,409,889 | A | * | 4/1995 | Das | 505/210 |
| 5,451,567 | A | * | 9/1995 | Das | 505/210 |
| 5,557,286 | A | * | 9/1996 | Varadan et al. | 343/700 MS |
| 5,703,020 | A | * | 12/1997 | Das | 505/210 |
| 6,160,524 | A | * | 12/2000 | Wilber | 343/787 |

FOREIGN PATENT DOCUMENTS

| | | | |
|---|---|---|---|
| EP | 0608889 | 8/1994 | H01P/1/18 |
| JP | 2-127804 | 5/1990 | H01Q/11/08 |
| JP | 3-85906 | 4/1991 | H01Q/3/32 |
| JP | 5-243905 | 9/1993 | H03H/17/00 |
| JP | 7-7303 | 1/1995 | H01P/1/18 |
| JP | 7-111407 | 4/1995 | H01P/3/08 |

OTHER PUBLICATIONS

J. I. Alonso, et al., "Low Cost Electronically Steered Antenna and Receiver System for Mobile Satellite Communications", IEEE MTT–S Int Microw Symp Dig., vol. 2, 1996.

* cited by examiner

*Primary Examiner*—Don Wong
*Assistant Examiner*—Hoang Nguyen
(74) *Attorney, Agent, or Firm*—Wenderoth, Lind & Ponack, L.L.P.

(57) ABSTRACT

An active phased array antenna according to the present invention comprises plural antenna patches 106*a*–106*p* which are arrayed in matrix on a dielectric substrate at equal intervals in the row and column directions, a grounded feeding terminal 108 which is applied with high-frequency electric power, a first control voltage generating means 111 which generates a row-direction orientation control voltage, and a second control voltage generating means 112 which generates a column-direction orientation control voltage. The plural antenna patches 106 are connected to the feeding terminal 108 by feeding lines 121, branching off from the feeding terminal 108 respectively, and plurally provided phase shifters 107 are arranged constituting a part of the feeding lines 121.

In the so-constructed active phased array antenna, a low-cost active phased array antenna which is of a simpler structure and capable of continuously changing antenna orientation characteristics can be realized.

15 Claims, 10 Drawing Sheets

ACTIVE PHASED ARRAY ANTENNA AND ANTENNA CONTROLLER

DESCRIPTION

1. Technical Field

The present invention relates to an active phased array antenna and an antenna controlling apparatus and, more particularly, to an active phased array antenna which receives and transmits a microwave in a communication equipment such as a wireless for mobile object identification equipment or a satellite broadcast receiving apparatus, as well as an active phased array antenna which receives and transmits millimeter waves employed in such as a collision preventing radar for automobiles, and also to an antenna controlling apparatus employed for controlling these active phased array antennas.

2. Background Art

Conventionally, a so-called active phased array antenna is generally used as an antenna which receives and transmits microwaves and millimeter waves.

This active phased array antenna conventionally used will be described with reference to figures.

FIG. 10(*a*) is a diagram schematically illustrating a construction of a conventional active phased array antenna 100, and FIG. 10(*b*) exemplifies the construction of a phase shifter 707 as an element constituting the active phased array antenna 100.

The conventional active phased array antenna 100 includes plural antenna patches 706*a*–706*p* arrayed on a dielectric substrate and a feeding line 710 for distributing a high-frequency signal applied to a feeding terminal 711 to respective antenna patches 706. The active phased array antenna 100 also includes phase shifters 707*a*–707*p* corresponding to respective antenna patches 706 which are arranged on the feeding line 710 and changes a phase of the high-frequency signal passing therethrough and a control circuit 708 which applies a desired dc control voltage to each phase shifter 707 and controls a phase shift of the high-frequency signal passing each phase shifter 707. While sixteen antenna patches 706 and sixteen phase shifters 707 are provided, respectively, in FIG. 10, this is only an example.

Further, FIG. 10(*b*) is a diagram illustrating the construction of the phase shifter 707 used in the active phased array antenna 100. All the phase shifters 707 have the identical constructions.

The phase shifter 707 includes first transmission lines 14*a* and 20*a* at an input side and an output side which are connected to the feeding line 710 as transmission lines that transmit inputted high-frequency signals, second transmission lines 14*b* and 20*b* at the input side and the output side which are connected to a dc power source through high-frequency blocking elements 21 and 27, an intermediate transmission line 17 which is connected to a dc power source through a high-frequency blocking element 24, a first and a second transmission lines for switching 15 and 16 of different lengths which are connected to a first control line V1 and a first inversion control line NV1 through the high-frequency blocking element 24, respectively, and a third and a fourth transmission lines for switching 18 and 19 of different lengths which are connected to a second control line V2 and a second inversion control line NV2 through high-frequency blocking elements 25 and 26, respectively.

A dc blocking element 12 which blocks a direct current is connected between the first transmission line 14*a* and the second transmission line 14*b* at the input side, and a blocking element 13 which blocks a direct current is connected between the first transmission line 20*a* and the second transmission line 20*b* at the output side, respectively.

Further, the first and the second transmission lines for switching 15 and 16 are located between the intermediate transmission line 17 and the second transmission line 14*b* at the input side.

Connected between an input side end of the first transmission line for switching 15 and an output side end of the second transmission line 14*b* at the input side is a PIN diode 31*a* connected in a forward direction viewed from the second transmission line 14*b* to the first transmission line for switching 15, and between an output side end of the first transmission line for switching 15 and an input side end of the intermediate transmission line 17 is a PIN diode 31*b* connected in a forward direction viewed from the intermediate transmission line 17 to the first transmission line for switching 15, respectively.

Connected between an input side end of the second transmission line for switching 16 and an output side end of the second transmission line 14*b* at the input side is a PIN diode 32*a* connected in a forward direction viewed from the second transmission line 14*b* to the second transmission line for switching 16, and connected between an output side end of the second transmission line for switching 16 and an input side end of the intermediate transmission line 17 is a PIN diode 32*b* connected in a forward direction viewed from the intermediate transmission line 17 to the second transmission line for switching 16.

Further, the third and the fourth transmission lines for switching 18 and 19 are located between the intermediate transmission line 17 and the second transmission line 20*b* at the output side.

Connected between an input side end of the third transmission line for switching 18 and an output side end of the intermediate transmission line 17 is a PIN diode 33*a* connected in a forward direction viewed from the intermediate transmission line 17 to the third transmission line for switching 18, and connected between an output side end of the third transmission line for switching 18 and an input side end of the second transmission line 20*b* at the output side is a PIN diode 33*b* connected in a forward direction viewed from the second transmission line 20*b* to the third transmission line for switching 18.

Connected between an input side end of the fourth transmission line for switching 19 and an output side end of the intermediate transmission line 17 is a PIN diode 34*a* connected in a forward direction viewed from the intermediate transmission line 17 to the fourth transmission line for switching 19, and connected between an output side end of the fourth transmission line for switching 19 and an input side end of the second transmission line 20*b* at the output side is a PIN diode 34*b* connected in a forward direction viewed from the second transmission line 20 to the fourth transmission line for switching 19.

The operation of the active phased array antenna which is provided with the so-constructed phase shifters 707 will be described.

When a high-frequency electric power is applied to the feeding terminal 711, the high-frequency electric power is supplied to respective antenna patches 706 through respective phase shifters 707. Then, a corresponding control voltage required is applied to each phase shifter 707, and a processing of making the phase of the high-frequency electric power advanced or delayed by a prescribed phase shifter is performed at each phase shifter 707 on the basis of the control voltage from the control circuit 708. Thereby, the high-frequency electric powers of the prescribed positions are inputted from respective antenna patches 706.

In this way, the active phased array antenna 100 performs a control of its orientation characteristics by applying a dc control voltage from the control circuit 708 to respective phase shifters 707 to change the phase shift quantity.

Next, the operation of the phase shifter will be described.

The high-frequency electric power supplied to the phase shifter 707 through the feeding line 710 passes through sequentially the first transmission line 14*a* at the input side, the dc blocking element 12, the second transmission line 14*b* at the input side, either one of the first and the second transmission lines for switching 15 and 16, the intermediate transmission line 17, either one of the third and the fourth transmission lines for switching 18 and 19, the second transmission line 20*b* at the output side, the dc blocking element 13, and the first transmission line 20*a* at the output side, and is propagated to the antenna patch 706.

Then, a control voltage for switching ON/OFF of the corresponding PIN diodes 31, 32, 33, and 34 is applied from the respective control lines V1, V2, NV1, and NV2 to respective transmission lines 15, 16, 18, and 19, so that respective PIN diodes 31, 32, 33, ad 34 are switched ON/OFF according to the control voltage. Thereby, the length of the transmission line through which the high-frequency electric power passes in the phase shifter 707 is changed, and the high-frequency electric power is outputted with its phase advanced or delayed by the prescribed phase shift.

However, in the conventional phase shifter 707 having the above-described construction which constitutes the prior art active phased array antenna 100, since the internal transmission lines are switched by a control voltage to change a phase shift, the phase shift is performed not successively but step by step, and this made it necessary to provide a circuit construction for switching transmission lines corresponding to the stage number (step number), i.e., that including transmission lines for switching, high-frequency blocking elements, control lines, and the like.

In other words, there exists a problem in that a construction which enables performing a phase shift with fine steps as well as obtaining a large phase shift, a large number of circuit constructions for switching transmission lines are required.

Further, also in a case where a large number of antenna patches are provided to obtain an antenna with a large gain, there is a problem that the circuit construction and wirings constituting the phase shifter are complicated.

Further, as a phase shifter employed for the conventional active phased array antenna, there is also one combining a varactor diode with a microstrip hybrid coupler. Though the varactor diode can continuously change orientation, it has a low control voltage, i.e., of several volts because it utilizes a junction capacitance of a PN junction, and therefore, when a passing electric power of a high-frequency signal which passes through the phase shifter is high, the junction capacitance would change by the signal voltage, resulting in that a lot of higher harmonics are generated. Therefore, it was not general to employ a phase shifter having such a construction.

Further, while dielectric substrate materials of the microstrip structure control the high frequency propagation characteristics as well as supports antenna patches or feeding line conductors, the dielectric materials are required to have as its high-frequency characteristics that of small loss and stable dielectric constant when materials having these characteristics are employed as dielectric materials, a problem arises that a larger portion of the antenna cost is occupied thereby.

The present invention is made to solve the above-mentioned problems and has for its object to provide a low cost active phased array antenna, and an antenna controlling apparatus, which is of simpler structure and capable of continuously changing antenna orientation characteristics.

DISCLOSURE OF THE INVENTION

According to Claim 1 of the present invention, there is provided an active phased array antenna which has a structure in which plural antenna patches and a feeding terminal for applying a high-frequency electric power to a dielectric substrate are provided on the dielectric substrate, the respective antenna patches and the feeding terminal are connected by feeding lines branching off from the feeding terminal, and a phase shifter which can electrically change the phase of a high-frequency signal passing on the respective feeding lines are arranged to constitute a part of the feeding lines, and the phase shifter comprises a microstrip hybrid coupler which employs paraelectrics as base material and a microstrip stab which employs ferroelectrics as base material and which is electrically connected to the microstrip hybrid coupler, and a dc control voltage is applied to the microstrip stab to change the passing phase shift quantity.

Therefore, by changing a control voltage, the passing phase shift quantity can be changed successively, and further, a phase shifter and a feeding line can be constituted by a single conductor layer, whereby it is possible to supply a control voltage to plural phase shifters through a single control line, thereby simplifying a wiring.

According to Claim 2 of the present invention, there is provided an active phased array antenna as defined in Claim 1, wherein the plural antenna patches are arranged in matrix at equal intervals in the row and column directions respectively, the phase shifters are arranged so that the number of the phase shifters inserted between each antenna patch in each row and the feeding terminal is larger by one sequentially than the number of the phase shifters inserted between each antenna patch in adjacent row and the feeding terminal, and so that the number of the phase shifters inserted between each antenna patch in each column and the feeding terminal is larger by one sequentially than the number of the phase shifters inserted between each antenna patch in adjacent column and the feeding terminal, and all the phase shifters have the same characteristics in the row and column directions respectively.

Therefore, it is possible to control antenna the orientation characteristics of an antenna regardless of the number of antenna patches only by changing a control voltage applied from the both end sides of a control line to which plural phase shifters are connected.

According to Claim 3 of the present invention, there is provided an active phased array antenna as defined in Claim 1 or 2, wherein the active phased array antenna is constructed by laminating seven layers, which seven layers comprises a first layer, a second layer, . . . , a seventh layer sequentially from the top layer, and the first, third, fifth, and seventh layer comprise dielectric material, while the second, fourth, and sixth layer comprise conductor, and further, the active phased array antenna has a first microstrip structure comprising the first, second, third, and fourth layer, and a second microstrip structure comprising the fourth, fifth, sixth, and seventh layer and the first microstrip structure and the above-mentioned second microstrip structure share the fourth layer as a grounded layer, and further, the antenna patch is provided in the second layer, the feeding line and the phase shifter are provided in the sixth layer, air is employed in the third layer, and a combination of air and the ferroelectrics is employed in the fifth layer.

Therefore, as a dielectric material between conductor layers of the microstrip structure, air which causes a significantly small loss of a high-frequency electric power and has a stable dielectric constant is used, and as a dielectric base material outside the surface of the feeding line conductor layer, a dielectric member which supports an antenna patch and a feeding line conductor is used, whereby they may also serve as protective layers at the antenna surface, resulting in a low cost device with a simple structure.

According to Claim 4 of the present invention, there is provided an active phased array antenna which is provided with a phase shifter that comprises at least an open end stab having ferroelectrics and ferromagnetic materials as base materials, and a microstrip hybrid coupler having paraelectrics as base materials.

According to Claim 5 of the present invention, there is provided an active phased array antenna as defined in Claim 4, wherein the open end stab is constituted by laminating a grounded conductor, the ferroelectric, a strip conductor, and the ferromagnetic materials, sequentially.

According to Claim 6 of the present invention, there is provided an active phased array antenna as defined in Claim 4, wherein the open end stab is constituted by laminating the grounded conductor, the ferroelectric, the ferromagnetic materials, and the strip conductor, and the ferroelectrics and the ferromagnetic materials are laminated between the grounded conductor and the strip conductor in a surface direction parallel to the grounded conductor surface.

Therefore, the active phased array antennas defined in Claims 4 to 6 can realize an active phased array antenna which is of a simple structure and enables continuous and wide variations of orientation characteristics with a simple structure.

According to Claim 7 of the present invention, there is provided an antenna controlling apparatus which is molded employing ferroelectrics, ferromagnetic materials, paraelectrics, and electrode materials by an integral molding using ceramics, and the above-mentntioned antenna controlling apparatus is provided with a function of a phase shifter.

According to Claim 8 of the present invention, there is provided an antenna controlling apparatus which is molded employing ferroelectrics, ferromagnetic materials, paraelectrics, and electrode materials by an integral molding using ceramics, and the antenna controlling apparatus is provided with functions of a phase shifter and a dc blocking element.

According to Claim 9 of the present invention, there is provided an antenna controlling apparatus which is molded employing ferroelectrics, ferromagnetic materials, paraelectrics, and electrode materials by an integral molding using ceramics, and the antenna controlling apparatus is provided with functions of a phase shifter, a dc blocking element, and a high-frequency blocking element.

According to Claim 10 of the present invention, there is provided an antenna controlling apparatus which is molded employing ferroelectrics, ferromagnetic materials, paraelectrics, and electrode materials by an integral molding using ceramics, and the antenna controlling apparatus is provided with functions of a phase shifter, a dc blocking element, and a high-frequency blocking element, and an antenna patch.

Therefore, an active phased array antenna which employs the antenna controlling apparatuses defined in Claims 7 to 10 of the present invention can realize an active phased array antenna with a less performance degradation due to accuracy variations at the assembly.

According to Claim 11 of the present invention, there is provided an active phased array antenna as defined in any of Claims 1 to 3, wherein an antenna controlling apparatus as defined in any of Claims 7 to 10 is provided.

According to Claim 12 of the present invention, there is provided an active phased array antenna comprising a row-column array antenna wherein row array antennas, in each of which antenna patches and phase shifters are connected alternately serially, are connected with phase shifters alternately in series, in which there is provided an antenna controlling apparatus as defined in any of Claims 7 to 10.

Therefore, the active phased array antennas defined in Claims 11 or 12 can realize an active phased array antenna which is of a simple structure and capable of continuously changing orientation characteristics.

According to Claim 13 of the present invention, in the active phased array antenna as defined in any of Claims 1 to 12, the grounded conductor is subjected to drawing.

According to Claim 14 of the present invention, there is provided an active phased array antenna as defined in Claim 13, wherein all the feeding lines are provided with a strip conductor comprising a linear conductor having identical sectional shape.

Therefore, the active phased array antenna defined in Claim 13 or 14 can realize a high-gain active phased array antenna without employing an expensive low-loss dielectric material.

According to Claim 15 of the present invention, there is provided an active phased array antenna as defined in any of Claims 1 to 6, or Claim 12, a supporting dielectric material, the grounded conductor, and the strip conductor for feeding are laminated to form the lamination, and this lamination and an antenna controlling apparatus as defined in any of Claims 7 to 10 are molded by an integral molding using ceramics.

Therefore, it is possible to realize a high-performance active phased array antenna in a millimeter wave.

BEST MODE TO EXECUTE THE INVENTION

Hereinafter, embodiments of the present invention will be described with reference to FIGS. 1 to 9. Further, the embodiments to be described here are examples and are not necessarily restricted thereto.

Embodiment 1

An active phased array antenna according to the present invention will be described as a first embodiment with reference to figures.

Figure 1A:
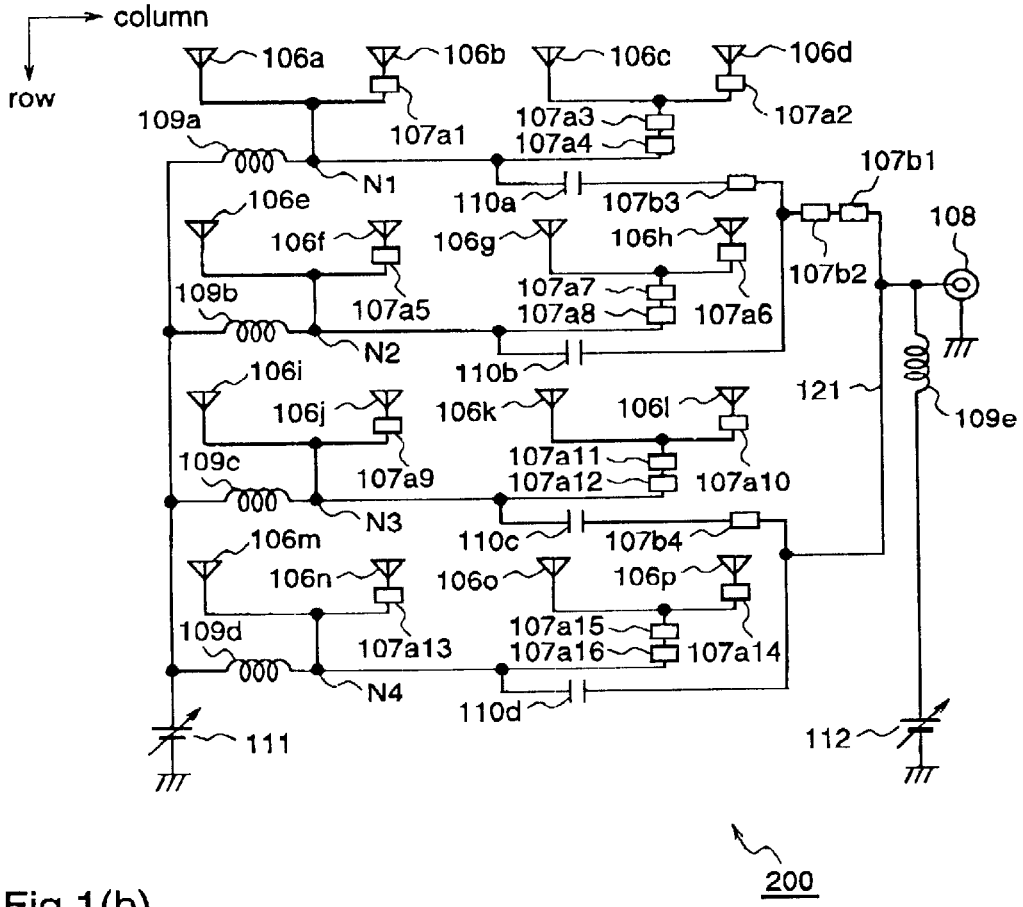
FIG. 1(*a*) is a diagram illustrating the structure of an active phased array antenna according to a first embodiment, and FIG. 1(*b*) is a diagram for explaining the maximum sensitivity direction of the received electric wave by an antenna patch of the active phased array antenna according to the first embodiment.
Figure 1B:
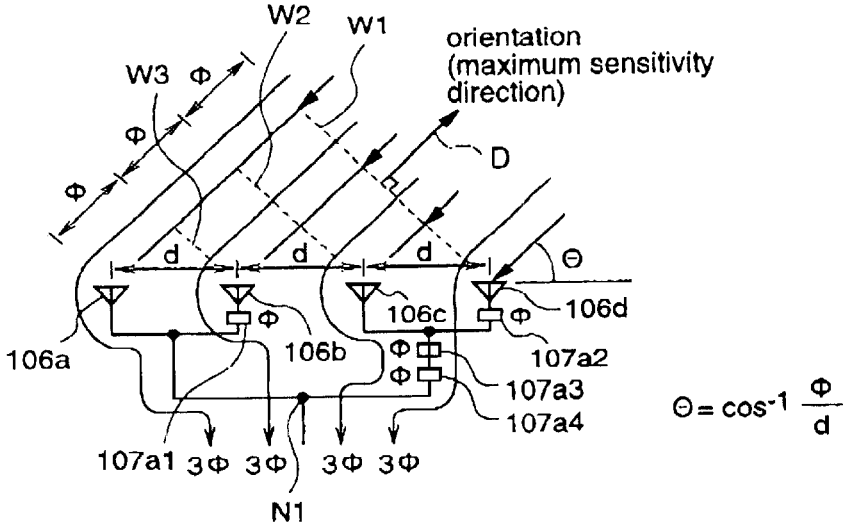

FIG. 1(*a*) is a block diagram for explaining an example of a structure of an active phased array antenna 200 according to this embodiment.

This active phased array antenna 200 comprises plural antenna patches 106*a*–106*p* which are arrayed in matrix on a dielectrtic substrate at equal intervals in the row and column directions, a grounded feeding terminal 108 which is applied with high-frequency electric power, a first control voltage generating means 111 which generates a row-direction orientation control voltage, and a second control voltage generating means 112 which generates a column-direction orientation control voltage. The plural antenna patches 106 are connected to the feeding terminal 108 by feeding lines 121, branching off from the feeding terminal 108 respectively. Plurally provided phase shifters 107 are arranged constituting a part of the feeding lines 121 as described later.

Further, on the dielectric substrate, there are formed first to fourth connection nodes N1–N4 which correspond to respective first to fourth rows in the matrix arrangement of the plural patches 106, and high-frequency blocking elements 109*a*–109*d* are connected between respective connection nodes N1–N4 and the first control voltage generating means 111 respectively.

The antenna patches 106*a*, 106*e*, 106*i*, and 106*m* which correspond to the first row, the second row, the third row, and the fourth row of a first column in the matrix arrangement of the plural patches 106 are directly connected to the first to fourth connection nodes N1–N4, respectively.

The antenna patches 106*b*, 106*f*, 106*i*, and 106*n* which correspond to the first row, the second row, the third row, and the fourth row of a second column are connected to the first to fourth connection nodes N1–N4 through the phase shifter 107*a*1, 107*a*5, 107*a*9, and 107*a*13, respectively.

The antenna patches 106*c*, 106*g*, 106*k*, and 106*o* which correspond to the first row, the second row, the third row, and the fourth row of a third column are connected to the first to fourth connection nodes N1–N4 through the two has shifters 107*a*3 and 107*a*4 in series connection, the two phase shifters 107*a*7 and 107*a*8 in series connection, the two phase shifters 107*a*11 and 107*a*12 in series connection, and the two phase shifters 107*a*15 and 107*a*16 in series connection, respectively The antenna patches 106*d*, 106*h*, 106*l*, and 106*p* which correspond to the first row, the second row, the third row, and the fourth row of a fourth column are connected to the first to fourth connection nodes N1–N4 through the three phase shifters 107*a*2–107*a*4 in series connection, the three phase shifters 107*a*6–107*a*8 in series connection, the three phase shifters 107*a*10–07*a*12 in series connection, and the three phase shifters 107*a*14–107*a*16 in series connection, respectively.

Further, the connection node N1 in the first row is connected to the feeding terminal 108 through a dc blocking element 110*a* and the three phase shifters 107*b*3–107*b*1 in series connection, the connection node N2 in the second row is connected to the feeding terminal 108 through the dc blocking element 110*b* and the two phase shifters 107*b*2 and 107*b*1 in series connection, the connection node N3 in the third row is connected to the feeding terminal 108 through a dc blocking element 110*c* and the phase shifter 107*b*4, and the connection node N4 in the fourth row is connected to the feeding terminal 108 through the dc blocking element 110*d*.

The second control voltage generating means 112 is connected to the feeding terminal 108 through the high-frequency blocking element 109*e*.

Further, the phase shifters 107*a*1–107*a*16 are phase shifters for controlling a row-direction orientation which control the row-direction orientation of the active phased array antenna 200 by a control voltage generated by the first control voltage generating means 111, and the phase shifters 107*b*1–107*b*4 are phase shifters for controlling a column-direction orientation which control the column-direction of the active phased array antenna 200 by a control voltage of the second control voltage generating means 112. In respective row and column directions, all the phase shifters 107*a*1–107*a*16 as well as 107*b*1–107*b*4 have the identical characteristics.

In the active phased array antenna 200 having such construction, the phase shifters are arranged such that the number of the phase shifters for controlling column-direction which are located between antenna patches in respective fist to fourth rows and the feeding terminal 108 is increased one by one successively from the fourth row to the first row, as well as that the number of the phase shifters for controlling row-direction orientation which are located between antenna patches in respective first to fourth columns and the feeding terminal 108 is increased one by one successively from the first column to the fourth column, and moreover, the characteristics of the phase shifters 107 are all identical in respective row and column directions, whereby controls of the orientations in the column direction and the row direction are performed by a single control voltage.

This will be described specifically. It is supposed that the phase of a high-frequency electric power which passes through the phase shifters for controlling row-direction 107*a*1–107*a*4 respectively is delayed by the phase shift $\Phi$, and arranging intervals between respective phase shifters are distance d.

Here, a high-frequency electric power inputted into the antenna patch 106*a* in the first row is supplied to the connection node N1 with its phase unchanged.

Meanwhile, a high-frequency electric power inputted into the antenna patch 106*b* in the first row has its phase delayed by the phase shift Φ by the phase shifters 107*a*1 and is supplied to the connection node N1.

A high-frequency electric power inputted into the antenna patch 106*c* in the first row has its phase delayed by the phase shift 2Φ by the phase shifters 107*a*3 and 107*a*4 and is supplied to the connection node N1.

A high-frequency electric power inputted into the antenna patch 106*d* in the first row has its phase delayed by the phase shift 3Φ by the phase shifters 107*a*2 and 107*a*4 and is supplied to the connection node N1.

In other words, the direction D at a prescribed angle Θ (Θ=cos−1 (Φ/d)) with respect to the arrangement direction of the antenna patches 106*a* to 106*d* in the first row becomes the maximum sensitivity direction of the electric wave received by the antenna patches 106*a* to 106*d* in the first row. Further, w1 to w3 in the figure denote wave surfaces of the received signal of identical phase.

Also, the orientation characteristics by antenna patches in other rows, that is, the second to the fourth rows are precisely identical to the orientation characteristics by the antenna patches in the first row.

Therefore, when a row-direction orientation control voltage generated by the first control voltage generating means 111 is changed, the phase shift Φ by respective phase shifters 107*a*1–107*a*16 is successively changed, whereby the angle Φ between the maximum sensitivity direction and the row direction changes in a surface vertical to the column direction.

On the other hand, the high-frequency electric power supplied to the connection node N4 corresponding to the fourth column is supplied to the feeding terminal 108 without causing a change in its phase.

Subsequently, the high-frequency electric power supplied to the connection node N3 corresponding to the third column has its phase delayed by the phase shift Φ by the phase shifter 107*b*4 and is supplied to the feeding terminal 108.

The high-frequency electric power supplied to the connection node N2 corresponding to the second column has its phase delayed by the phase shift 2Φ by the phase shifters 107*b*2 and 107*b*1 and is supplied to the feeding terminal 108.

The high-frequency electric power supplied to the connection node N1 corresponding to the first column has its phase delayed by the phase shift 3Φ by the phase shifters 107*b*3 to 107*b*1 and is supplied to the feeding terminal 108.

Therefore, when a row-direction orientation control voltage generated by the second control voltage generating means 112 is changed, the phase shift Φ by respective phase shifters 107*b*1–107*b*4 is successively changed, whereby the angle between the maximum sensitivity direction and the column direction changes in a surface vertical to the column direction.

Further, the dc blocking element 110*d* is provided between the connection node N4 corresponding to the fourth row and the feeding terminal, and the dc blocking elements 110*a*, 110*b*, and 110*c* are provided between the connection nodes N1–N3 corresponding to the first to third rows and the corresponding phase shifters 107*b*3, 107*b*2, and 107*b*4, whereby controls of the phase shifters 107 by control voltages from respective control voltage generating means 111 and 112 are performed individually for the phase shifters in the row direction and for the phase shifters in the column direction, respectively. Therefore, in the active phased array antenna 200, the orientation direction can be set to an arbitrary direction on a surface of transmitting/receiving electric waves of an antenna, that is, on a plane surface including the row direction and the column direction regardless of the number of the antenna patches.

Next, a description will be given of the phase shifter 107 as an element constituting the active phased array antenna 200.

Figure 2A:
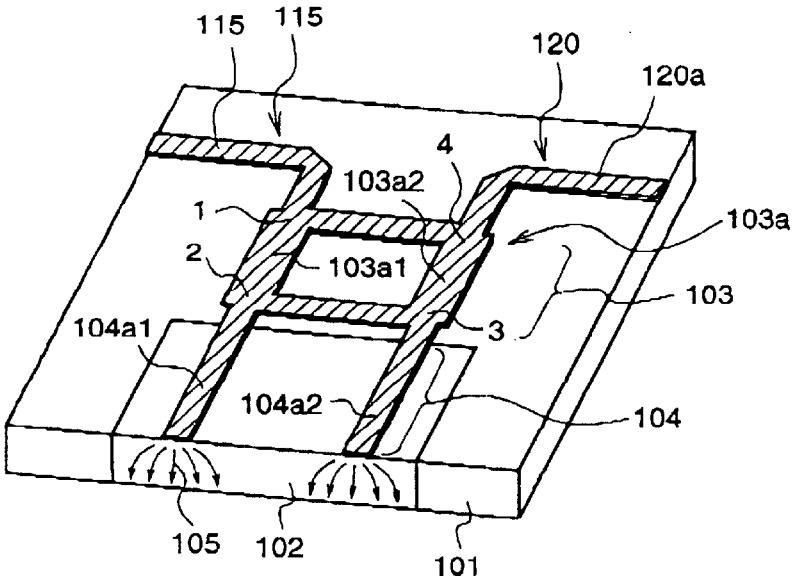
FIG. 2(*a*) is a diagram illustrating the construction of a phase shifter of the active phased array antenna according to the first embodiment, and FIG. 2(*b*) is a graph illustrating a change of the effective dielectric constant of a microstrip stab with relative to a bias electric field produced by a control voltage.
Figure 2B:
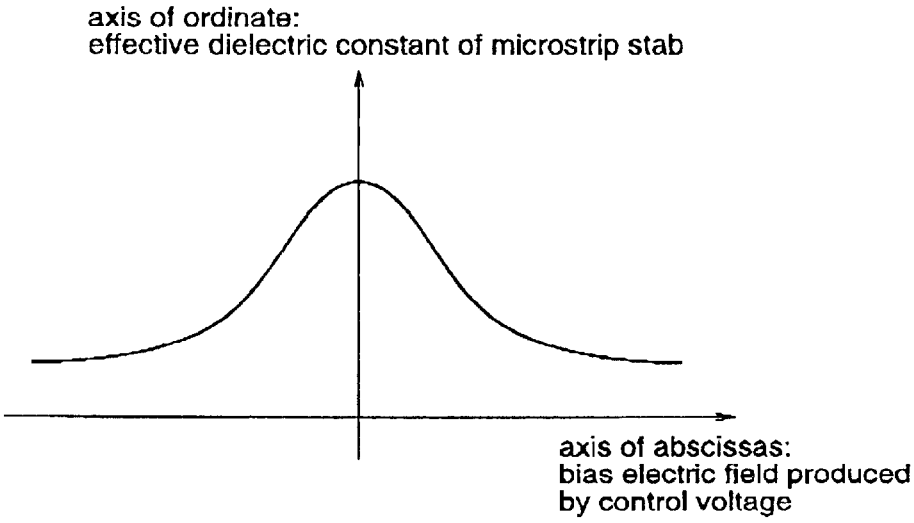

FIG. 2(*a*) is a perspective view illustrating the construction of the phase shifter 107 employed for the active phased array antenna 200.

This phase shifter 107 comprises a microstrip hybrid coupler 103 which employs a paraelectric base material 101 and constitutes a part of the feeding line 121, and a microstrip stab 104 which employs a ferroelectric base material 102 and is formed contacting the microstrip hybrid coupler 103. It is constituted such that the phase shift quantity of the high-frequency electric power passing through the microstrip hybrid coupler 103 is changed by a dc control voltage applied to the microstrip stab 104.

That is, the material of the phase shifter 107 comprises the paraelectric substrate 101 and the ferroelectric substrate 102.

An annular conductor layer 103*a* in a rectangular shape is disposed on the paraelectric base material 101, and the microstrip hybrid coupler 103 comprises these annular conductor layer 103*a* and the paraelectric 101.

Further, two linear conductor layers 104*a*1 and 104*a*2 are disposed on the ferroelectric 102 so that they are located where two facing linear parts 103*a*1 and 103*a*2 of the annular conductor layer 103*a* in a rectangular shape are extended, as well as they are connected to one ends of the two linear parts 103*a*1 and 103*a*2, respectively, and the microstrip stab 104 comprises the two linear conductor layers 104*a*1 and 104*a*2 as well as the ferroelectric 102.

Further, conductor layers 110*a* and 120*a* are arranged on the paraelectric 101 so that they are located where the two linear parts 103*a*1 and 103*a*2 are extended, as well as they are connected to the other ends of the two linear parts 103*a*1 and 103*a*2, respectively.

An input line 110 comprises the conductor layer 110*a* and the paraelectric 101, and an input line 120 comprises the conductor layer 120*a* and the paraelectric 101.

One end side and the other end side of the linear part 103*a*1 of the annular conductor layer 103*a* are a port 2 and a port 1 of the microstrip hybrid coupler 103, respectively, and one end side and another end side of the linear part 103*a*2 of the annular conductor layer 103*a* are a port 3 and a port 4 of the microstrip hybrid coupler 103. That is, the phase shifter 107 is constituted such that the phase shift quantity of the passing high-frequency electric power is changed by applying a dc control voltage to the microstrip stab 104.

This will be described in more detail.

In the phase shifter 107 having a construction in which identical reflection elements (microstrip stab 104) are connected to the adjacent two ports (port 2 and port 3) of the microstrip hybrid coupler 103 correctly design, a high-frequency electric power inputted from an input port (port 1) is not outputted from this input port, and a high-frequency electric power reflecting the electric power reflected by the reflection elements is only outputted to an output port (port 4). Since the reflection at the microstrip stab 104 as a reflection element is such that the bias electric field 105 produced by a control voltage is directed in the same direction as the electric field produced by a high-frequency electric power which propagates through the microstrip stab 104 as shown in FIG. 2(*a*), when the control voltage is changed, the effective dielectric constant of the microstrip stab 104 for the high-frequency electric power is also changed as shown in FIG. 2(*b*).

Here, since the bias electric field 105 required for changing the effective dielectric constant of the microstrip stab 14 is several-kilovolts/millimeter to several-tens-kilovolts/millimeter in a typical ferroelectric, there is no case where higher harmonic waves are generated due to that the effective dielectric constant is affected by the electric field produced by the high-frequency electric power which propagates on the microstrip stab 104.

As described above, in the phase shifter 107 constituting the active phased array antenna 200, when a control voltage is changed, the phase shift quantity of a high-frequency electric power is changed, ad further, since the phase shifter 107 and the feeding line 121 are composed of a conductor layer, it is possible to supply a control voltage to plural phase shifters 107 through a single feeding line 121.

Next, a specific structure of the active phased array antenna 200 will be described.

Figure 3:
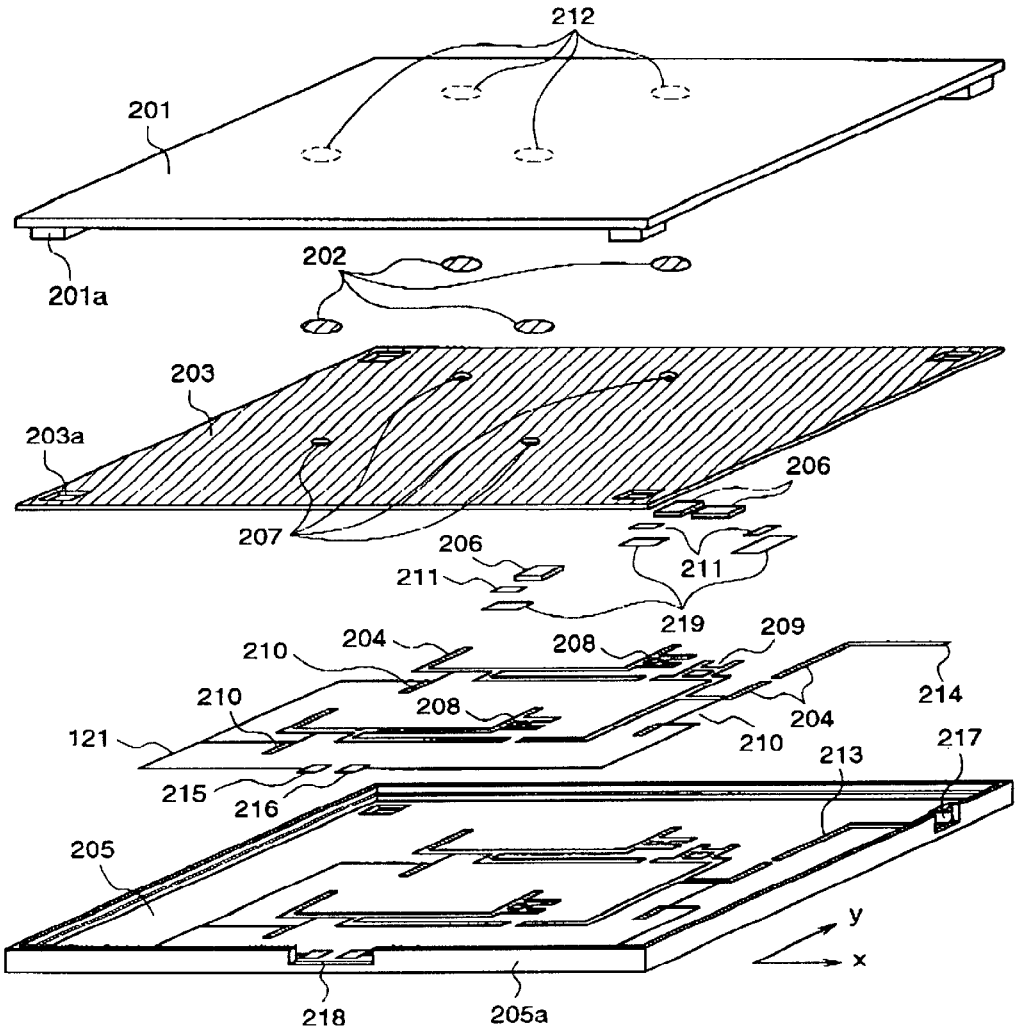
FIG. 3 is an exploded perspective view illustrating the structure of the active phased array antenna according to the first embodiment.

FIG. 3 is an exploded perspective view for explaining the structure of the active phased array antenna 200. Four antenna patches 202 described in FIG. 3 correspond to the antenna patches 106*i*, 106*j*, 106*m*, and 106*n* of the active phased array antenna 200. Other parts will not be described in particular here.

A further description will be given with reference to FIGS. 1 and 3. The active phased array antenna 200 has a plate shaped dielectric 205, around which a peripheral wall 205*a* is provided.

A groove for supporting feeding line 213 is provided on the dielectric 205, and a conductor layer 204, which constitutes the feeding line 121, the microstrip hybrid coupler 103 as well as the microstrip stab 104, and the dc blocking element 110 as well as the high-frequency blocking element 109, is inserted and is fixed in the feeding line supporting groove 213.

On a part of the conductor layer 204 constituting the dc blocking element 110, a conductor piece (conductor piece for dc blocking capacity) 211 which constitutes the dc blocking element 110 is laminated via an insulation film (film for dc blocking capacity) 219 which constitutes the dc blocking element 110 (capacity element).

A ferroelectric member 206 is disposed on a part of the conductor layer 204 constituting the microstrip stab 104.

On the dielectric 205, a sharing grounded conductor layer 203 is arranged at a prescribed distance from the conductor layer 204 so as to cover the conductor layer 204, the conductor piece for dc blocking capacity 211, and the ferroelectric member 206.

A coupling window 207 is provided at a part of the sharing grounded conductor layer 203 corresponding to the side end of the antenna patch 202 of the feeding line 121.

On the sharing grounded conductor layer 203, a plate shaped dielectric member 201 is arranged so as to provide a prescribed interval with the sharing grounded conductor layer 203.

The plate shaped dielectric member 201 is supported on the dielectric 205 by a supporting member 201*a* penetrating an element through hole 203*a* provided on the sharing grounded conductor layer 203.

An antenna patch supporting groove 212 is provided at a part of the plate dielectric member 201 opposing the coupling window 207, and an antenna patch 202 is embedded and fixed in the antenna patch supporting groove 212.

Further, numeral 214 denotes a feeding terminal formed at an end of the feeding line 121, numeral 215 denotes a control terminal for applying a control voltage to control the orientation in the X direction (row direction), numeral 216 denotes a control terminal for applying a control voltage to control the orientation in the Y direction (column direction), numeral 208 denotes a phase shifter for X-direction orientation control, and numeral 209 denotes a phase shifter for Y-direction orientation control. Further, numeral 210 denotes a high-frequency blocking stab and numeral 211 denotes a conductor piece for dc blocking capacity. An opening 217 for taking out feeding terminals is provided at a part facing the feeding terminal on the peripheral wall of the dielectric 205, and an opening 218 for taking out control terminals is provided at a part facing the control terminals 215 and 216 on the peripheral wall of the dielectric 205.

Figure 4:
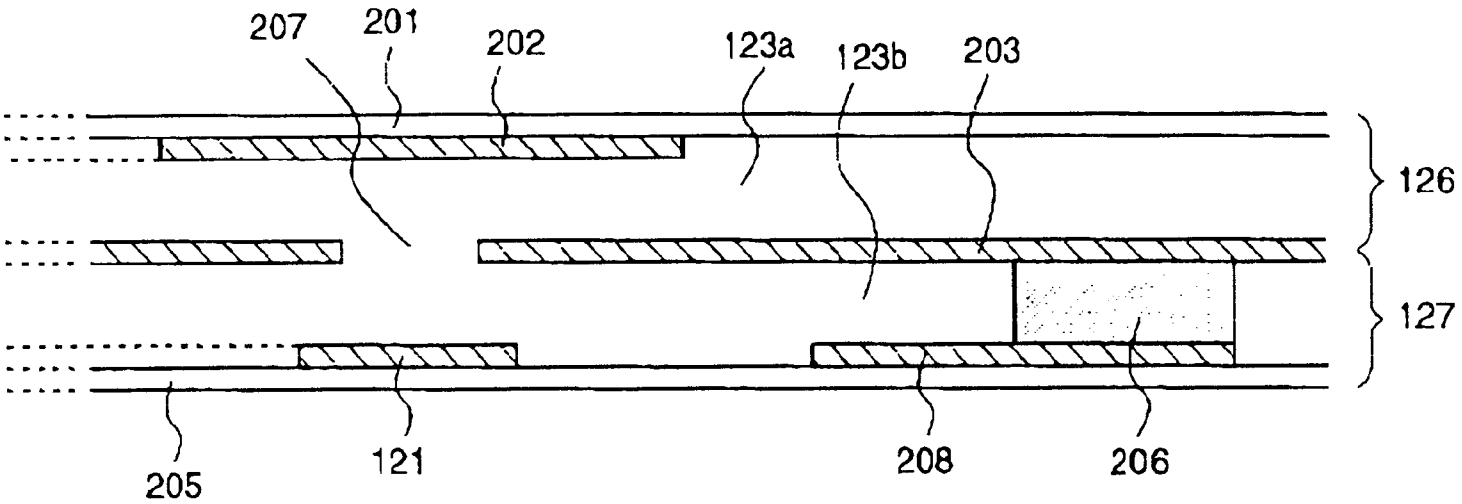
FIG. 4 is a diagram illustrating the cross-sectional structure (a part) of the active phased array antenna according to the first embodiment.
Figure 5A:
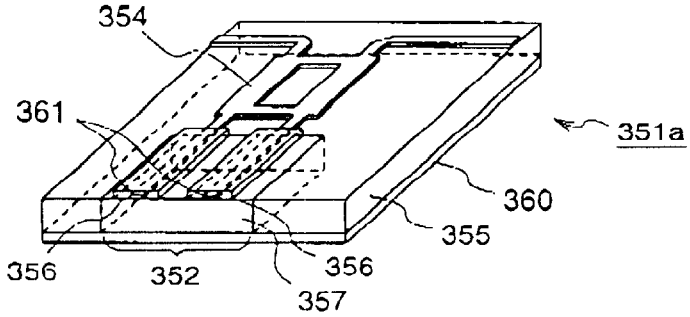
FIGS. 5(*a*), (*b*), and (*c*) are diagrams illustrating the construction of a phase shifter employed for an active phased array antenna according to a second embodiment, and FIG. 5(*d*) is a diagram illustrating a bias electric field produced by a control voltage in an open end stab and a magnetic field peoduced by a high-frequency electric power.
Figure 5B:
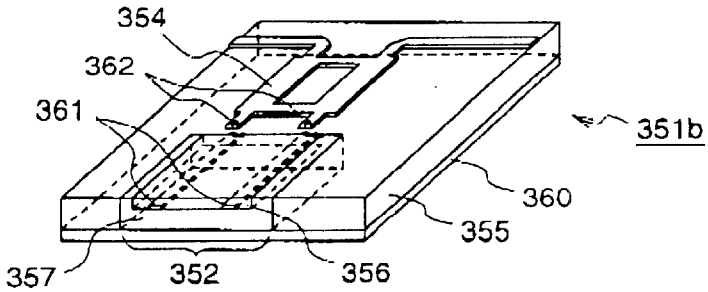
Figure 5C:
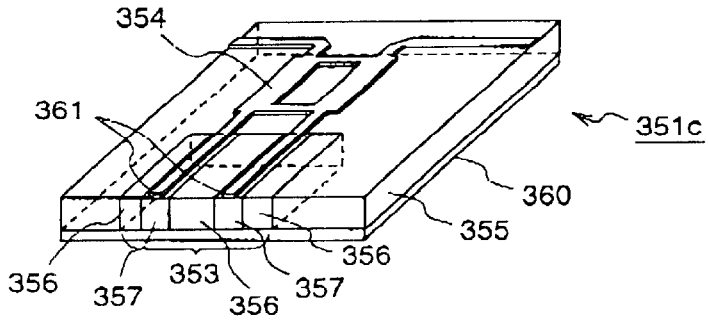
Figure 5D:
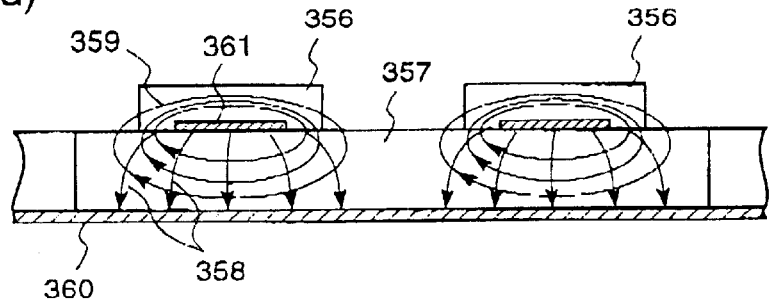

The active phased array antenna illustrated in FIG. 3 has the cross-sectional structure as illustrated in FIG. 4. More specifically, the cross-sectional view here illustrates the cross-sectional structure around a part corresponding to the antenna patch 106*j* and the phase shifter 107*a*9 of the active phased array antenna 200 illustrated in FIG. 1(*a*).

In this active phased array antenna 200, the whole comprises seven layers, respective layers being a first layer, . . . a seventh layer sequentially from the top layer, and the dielectric member 201 in a first layer, an air space 123*a* in a third layer, an air space 123*b* and the ferroelectric member 206 in a fifth layer, and the dielectric 205 in the seventh layer are made from dielectric materials, while the antenna patch 202 in a second layer, the sharing grounded conductor layer 203 in a fourth layer, and the feeding line 121 and the phase shifters 208 and 209 in a sixth layer are made from conductors, and these are laminated to make a construction. Further, a first microstrip structure 126 comprises the first layer, the second layer, the third layer, and the fourth layer, while a second microstrip structure 127 is composed of the fourth layer, the fifth layer, the sixth layer, and the seventh layer, and the first microstrip structure 126 and the second microstrip structure 127 shares the fourth layer as a grounded layer.

The antenna patch 202 and the feeding line 121 are coupled electromagnetically through the coupling window 207 provided on the sharing grounded conductor layer 203, thereby to transfer a high-frequency electric power.

As described above, in the active phased array antenna 200 according to the present invention, a high-frequency electric power which propagates through the antenna patch 202 (106) or the feeding line 121 flows intensively almost between the conductor layer and the sharing grounded conductor layer 203 constituting the antenna patch 202 and between the conductor layer 204 and the sharing grounded conductor layer 203 constituting the antenna feeding line 121, and therefore, as a dielectric base material between these conductor layers, air which causes a significantly small loss and has a stable dielectric constant is used.

In addition, as a dielectric substrate outside the surface of the conductor layer constituting the antenna patch 202 and the feeding line 121, which provides no necessity of requiring a small loss and the dielectric stability since a high-frequency electric power is not concentrated, the dielectrics 201 and 205 which support the conductor constituting the antenna patch 202 and the feeding line 121 is employed as it is.

Further, the dielectric base materials 201 and 205 may also serve as protective layers for the surface of the active phased array antenna 200.

With such construction, the conventional problem that the cost of the active phased array antenna would be determined by the cost of the dielectric of microstrip structure, which should play a role of controlling propagation characteristics of a high-frequency electric power as well as supporting the antenna patch and the feeding line conductor, while should be small in loss and stable in dielectric constant as high-frequency characteristics, can be solved, and the active phased array antenna can be realized with a simple structure and at a low cost.

The operation of the above-mentioned active phased array antenna 200 according to this embodiment will be described.

First, when a high-frequency electric power is inputted into the antenna patches 106*a*–106*p*, the high-frequency electric power is supplied from the antenna patch 106 to the feeding terminal 108 through the corresponding dc blocking elements or phase shifters.

Specifically, the high-frequency electric power inputted into the antenna patch 202 (106) is transferred to the feeding line 121 through the coupling window 207. When the high-frequency electric power is transferred to the feeding line 121, it is supplied to the phase shifter 107 through the feeding line 121. At this time, a row-direction orientation control voltage and a column-direction orientation control voltage are supplied to the respective phase shifters 107 from the first control voltage generating means 111 and the second control voltage generating means 112. Therefore, the high-frequency electric power has its phase changed for a phase shift quantity determined by these voltages, and are outputted to the feeding terminal through the feeding line.

As described above, in this embodiment, the phase shifter 107 constituting the active phased array antenna 200 is constituted by the microstrip hybrid coupler 103, which constitutes a part of the feeding line 121 and has paraelectrics as base material, and the microstrip stab 104 which has ferroelectrics as base material and is electrically connected to the microstrip hybrid coupler 103, and the phase shift quantity of the high-frequency electric power passing through the microstrip hybrid coupler 103 is changed by a dc control voltage applied to the microstrip hybrid coupler 103, thereby changing the phase shift quantity of the high-frequency electric power successively.

Further, because the microstrip hybrid coupler 103 constitutes a part of the feeding lien 121 and the microstrip stab 104 is electrically connected with the microstrip hybrid coupler 103, it is possible to connect the plural phase shifters 107 to a single feeding line 121 an to construct the phase shifter 107 and the feeding line 121 with a single conductor layer 204, and therefore, it is possible to supply a control voltage to the plural phase shifters 107 through a single feeding line 121, thereby simplifying the wiring.

Further, since the phase shifter 107 and the feeding line 121 can be constructed with a single conductor layer 204, by adjusting the number of the phase shifters arranged between respective antenna patches 106 arrayed in matrix and the feeding terminal 108, it is possible to change a control voltage applied from both end sides of the feeding line 121, thereby to control the orientation characteristics of the active phased array antenna 200 continuously regardless of the number of the antenna patches 106.

Further, in the active phased array antenna 200 according to the embodiment, the dc blocking element 110 is provided between the first control voltage generating means 111 and the second control voltage generating means 112 so that a phase shift of a signal is performed individually for the phase shifters 107 in the row direction and for the phase shifters 107 in the column direction, whereby the maximum sensitivity direction of the active phased array antenna 200 can be set at an arbitrary direction on a plane surface including the row direction and the column direction by respective control voltage generating means 111 and 112, regardless of the number of the antenna patches 106.

Further, as a dielectric base material between the conductor layers of the microstrip structure, air which causes a significantly small loss of a high-frequency electric power and has a stable dielectric constant is used, and as a dielectric base material outside the surface of the feeding line conductor, the dielectric member supporting the antenna patch and the feeding line conductor is used, thereby it may serve as a protective layer of the antenna surface, thereby realizing a simple structure at a low cost.

While a case where the number of antenna patches is 4×4 is described in this embodiment, patch numbers other than this are also possible. Further, while a description was given of an antenna which is designed so that the lengths of the feeding lines from respective antenna patches to the feeding terminal excluding the phase shifters are equal to each other, a transmission line for offset may be provided at the length of the feeding line from each antenna patch to the feeding terminal excluding the phase shifters in order to previously give an offset in the direction of orientation characteristics.

While a construction method in which a line impedance in each branch-off line is not unified, thereby to omit a matching device is described in this embodiment, by providing a matching device at each branch point in the row and column directions to unify a line impedance, phase shifters all of which have the same characteristics in respective row and column directions can be used. In addition, by making unified impedance in both directions be the same, the active phased array in the present invention can be constructed with phase shifters whose characteristics are all the same. Further, while in the embodiment a description was given of the method in which the conductor layer constituting the antenna patch and the feeding line is embedded and fixed in the groove of concave structure which is provided in the dielectric substrate, the conductor layer may be fixed on the dielectric substrate as a column of convex structure, and further, a support structure of supporting the conductor layer by a method which is hardly affected by the dielectric constant of the dielectric substrate is also possible.

Embodiment 2

As shown in FIG. 2, the phase shifter 107 of the above-described active phased array antenna 200 according to the first embodiment has the microstrip hybrid coupler 103, which constitutes a part of the feeding line 121 and has paraelectrics as base material, and the microstrip stab 104 which has ferroelectrics as base material, and is provided contacting the microstrip hybrid coupler 103, and here, the relative dielectric constant of the ferroelectrics is generally high and a line impedance of the microstrip stab 104 generally tends to decrease. Therefore, a reflection of a high-frequency electric power is large at a connection part of the microstrip hybrid coupler 103 and the microstrip stab 104 and a large amount of high-frequency electric power is returned to the microstrip hybrid coupler 103 without entering the microstrip stab 104. As a result, an effective phase shift quantity cannot be obtained in many cases. Thus, variation amount in the antenna orientation characteristics is also restricted to a narrow range.

As shown in FIG. 5, in a phase shifter 351 employed for an active phased array antenna, a ferromagnetic layer 356 is provided close to a microstrip stab 361 which employs a ferroelectric base material 357, thereby increasing a line impedance of the microstrip stab 361 which is decreased by the ferroelectric base material 357, resulting in removing the above-mentioned defects.

An active phased array antenna which is provided with at least an open end stab which has the ferroelectrics and the ferromagnetic material as base material, and a microstrip hybrid coupler which has a paraelectrics as a base material will be described as a second embodiment with reference to figures.

As described above, FIG. 5 are perspective views of the phase shifter employed for the active phased array antenna and a cross-sectional view of the open end stab according to this embodiment.

First, the configuration of the phase shifter 351 shown in figures (a)–(c) will be described.

Numerals 352 and 353 denote open end stabs. The open end stab 352 is constituted by a grounded conductor, ferroelectrics, a strip conductor, and ferromagnetic material being laminated subsequently, and the open end stab 353 is constituted by the ferroelectrics and the ferromagnetic material being laminated between the grounded conductor and the strip conductor in a surface direction parallel to the grounded conductor surface.

Further, numeral 354 denotes a microstrip hybrid coupler, numeral 355 denotes a paraelectric base material, numeral 356 denotes a ferromagnetic layer, numeral 357 denotes a ferroelectric base material, numeral 360 denotes a sharing grounded conductor layer, numeral 361 denotes a microstrip stab, and numeral 362 denotes a beer hole.

In FIG. 5(*b*), numeral 358 denotes a bias electric field produced by a control voltage such as a dc control voltage and a high-frequency electric power, and numeral 359 denotes a magnetic field produced by a high-frequency electric power.

With respect to the alignment of the ferroelectric base material 357 and the ferromagnetic layer 356, structures in FIGS. 5(*a*), 5(*b*), 5(*c*), and the like are possible.

FIG. 5(*a*) has characteristics that the structure is simple and therefore a manufacturing method thereof is also simple, FIG. 5(*b*) has characteristics that the thickness of the phase shifter can be thinned, and FIG. 5(*c*) has characteristics that the thickness of the phase shifter is thinned and an interpolating via hole is not required.

The ferromagnetic layer 356 shown in FIG. 5 has an effect of increasing the line impedance of the microstrip stab 361 which is reduced by the ferroelectric base material 357, whereby a reflection of the electric power at a connection part of the microstrip hybrid coupler 354 and the microstrip stab 361 is small and most of the high-frequency electric power is input to the microstrip stab 361, thereby an effective phase shift quantity can be obtained. Thus, when an active phased array antenna employing the above-described phase shifter which can obtain the effective phase shift quantity is constituted, the active phased array antenna capable of widely changing orientation characteristics can be realized.

As described above, in the active phased array antenna according to the embodiment, the active phased array antenna which is capable of widely changing orientation characteristics can be realized.

Embodiment 3

When an active phased array antenna which can be used in a microwave/millimeter wave area is to be realized, not only performances of elements in respective functions constituting the active phased array antenna but also an accuracy in an assembly when constructing an antenna from respective constituent elements are generally important for the wavelength which the active phased array antenna handles. That is, when constructing an active phased array antenna employing respective constituent elements, the larger the number of constituent elements is, the faulty rate may be eminently deteriorated.

Then, it is thought of to construct an antenna controlling apparatus which has respective functional elements constituting the active phased array antenna is constituted by an integral molding technique, thereby preventing deterioration in the faulty rate.

That is, when an antenna controlling apparatus which is integrally molded as described above is employed for an active phased array antenna, the number of constituent elements employed for construction can be reduced, thereby resulting in reduction in the faulty rate.

While it is possible to reduce the deterioration of the performance and the faulty rate of an active phased array antenna by including al the functional elements in the integrated antenna controlling apparatus, when plural kinds of active phased array antenna are to be produced from a kind of antenna controlling apparatus, it is preferred that the kinds of functional elements provided in the antenna controlling apparatus should be greater.

For example, it is thought of that integrally molding one or plural phase shifter functions, integrally molding the phase shifter function and the dc blocking function, or integrally molding the phase shifter function, the dc blocking element, and the high frequency blocking element function can provide the kinds of combination of functional elements.

An antenna controlling apparatus according to the present invention will be described as a third embodiment with reference to figures.

The antenna controlling apparatus according to this embodiment is molded by an integral molding using ceramics, employing ferroelectrics, ferromagnetic materials, paraelectrics, and electrode materials.

The construction of the antenna controlling apparatus 400 will be described with reference to a perspective view shown in FIG. 6 which concerns an example of the integrally molded antenna controlling apparatus according to the embodiment.

Figure 6:
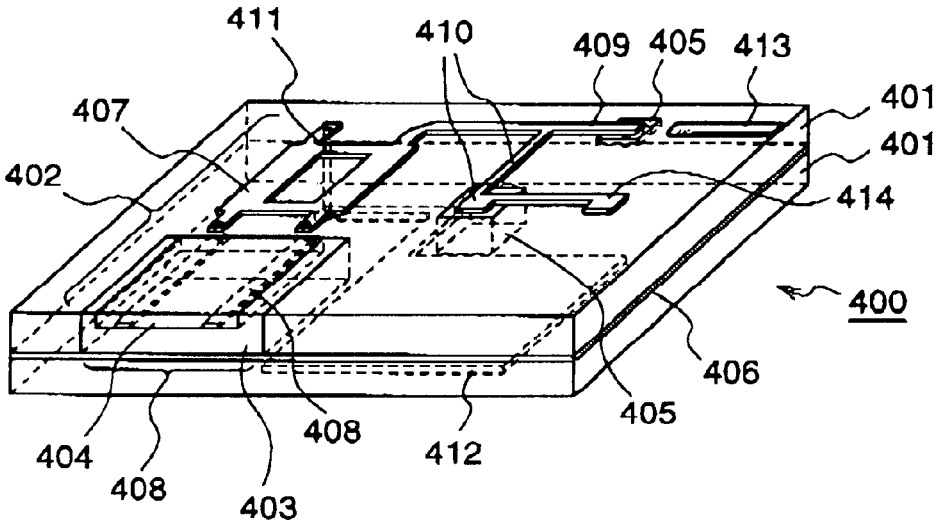
FIG. 6 is a perspective view illustrating an antenna controlling apparatus according to a third embodiment.

In FIG. 6, numeral 401 denotes a paraelectric base material, numeral 402 denotes a phase shifter, numeral 403 denotes a ferroelectric base material, numeral 404 denotes a ferromagnetic base material, numeral 405 denotes a dielectric material for capacitor, numeral 406 denotes a sharing grounded conductor layer, numeral 407 denotes a microstrip hybrid coupler, numeral 408 denotes an open end stab, numeral 409 denotes a dc blocking element, numeral 410 denotes a high-frequency blocking element, numeral 411 denotes a via hole, numeral 412 denotes an antenna patch, numeral 413 denotes a feeding line, and numeral 414 denotes a dc control voltage terminal.

While functions of the phase shifter, the dc blocking element, the high-frequency blocking element, and the antenna patch are molded integrally in the antenna controlling apparatus 401 illustrated in the figure, it is also possible to, according to a property or a performance of an active phased array antenna employed, omit, for example, three members of the dc blocking element, the high-frequency blocking element, and the antenna patch, and mold only a function of the phase shifter. It is also possible to mold functions of the phase shifter and the dc blocking element, or to mold functions of the phase shifter, the dc blocking element, and the high-frequency blocking element as other combinations.

For example, in the active phased array antenna shown in FIG. 1, the phase shifter 107, the dc blocking element 110, the high-frequency blocking element 109, and the antenna patch 106 are integrally molded by an integral molding using ceramics, and this is employed for the antenna controlling apparatus, thereby reducing the number of functional elements employed for the active phased array antenna, resulting in reduction in variations concerning the performance.

As described above, various features are integrally molded by the integral molding using ceramics to constitute an antenna controlling apparatus, and this antenna controlling apparatus is employed for an active phased array antenna, thereby reducing the number of respective functional elements used for an active phased array antenna and variations concerning the performance of the active phased array antenna.

Therefore, by employing the antenna controlling apparatus according to the embodiment, an active phased array antenna with less performance degradation due to accuracy variation at the assembly can be realized, and further, many kinds of active phased array antenna can be manufactured with a single antenna controlling apparatus.

Embodiment 4

With reference to figures, an active phased array antenna 801 will be described as a fourth embodiment, which is a row-column array antenna wherein row array antennas, in each of which antenna patches and phase shifters are connected alternately serially, are connected with phase shifters alternately in series, and employs the antenna controlling apparatus described in the above-described third embodiment.

Figure 7A:
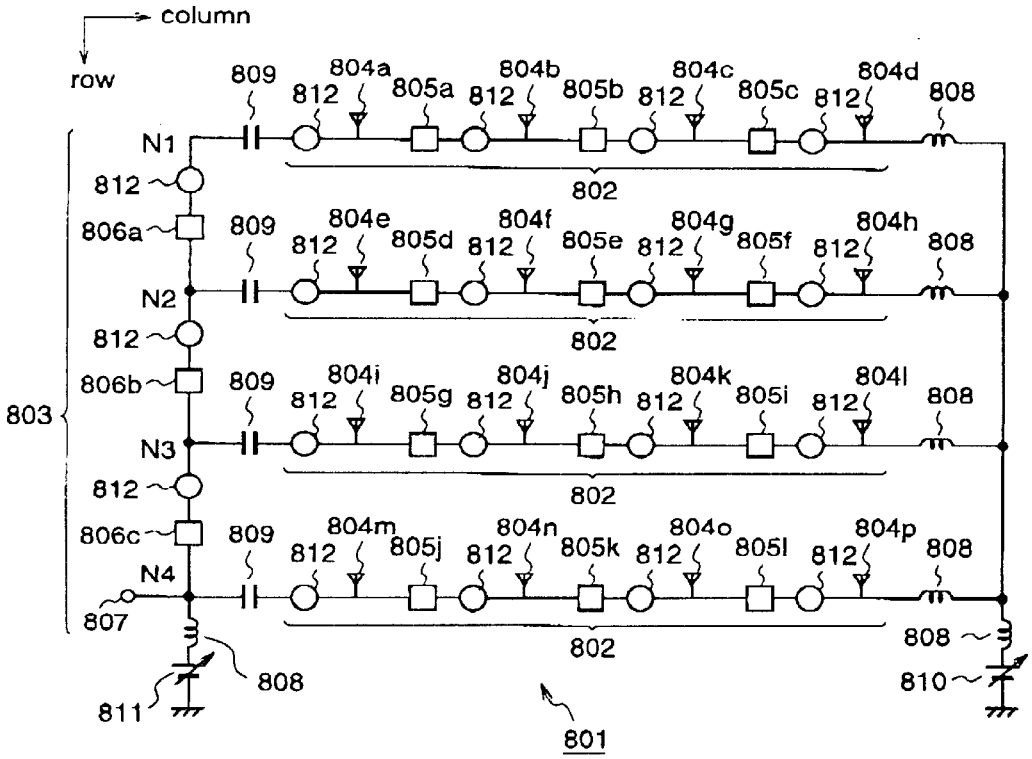
FIG. 7(*a*) is a block diagram illustrating the construction of an active phased array antenna according to a fourth embodiment, and FIG. 7(*b*) is a diagram for explaining the maximum sensitivity direction of the received electric wave by an antenna patch of the active phased array antenna according to the fourth embodiment.
Figure 7B:
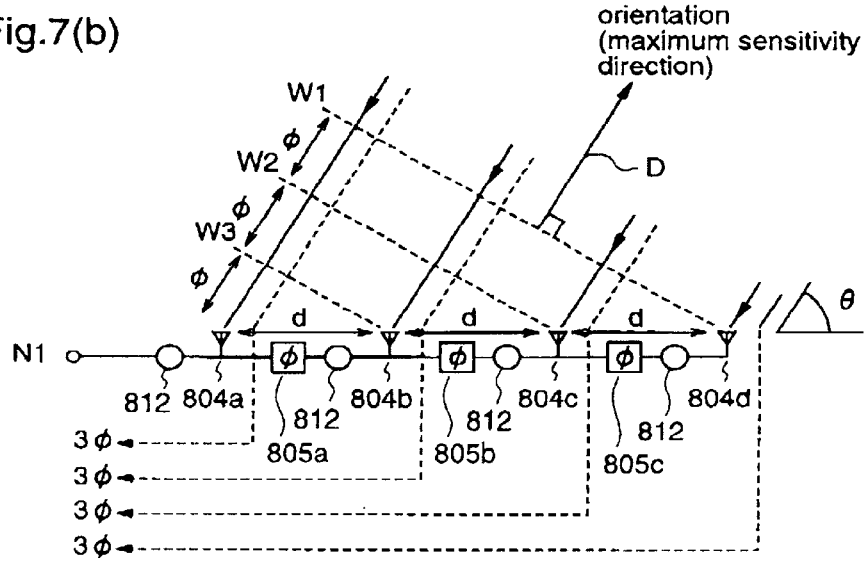

FIG. 7(*a*) is a diagram showing a construction of the active phased array antenna which is a row and column array antenna according to this embodiment.

In FIG. 7(*a*), numeral 802 denotes a row array antenna, numeral 803 denotes a row and column array antenna, numeral 804 denotes an antenna patch, numeral 805 denotes a row-direction orientation control phase shifter, numeral 806 denotes a column-direction orientation control phase shifter, numeral 807 denotes a feeding terminal, numeral 808 denotes a high-frequency blocking element, numeral 809 denotes a dc blocking element, numeral 810 denotes a row-direction orientation control voltage, numeral 811 denotes a column-direction orientation control voltage, and numeral 812 denotes a matching circuit.

In FIG. 7, the active phased array antenna 801 is a leakage wave antenna which aggressively employs a leakage wave from each patch 804. A leakage wave antenna is generally designed so that a patch far from the feeding terminal has a lower leakage electric power. However, in the active phased array antenna according to the present invention, a radiation impedance of each patch and a matching ratio of each matching device 812 are selected so that a leakage electric power from each patch is the same, so as to determine a maximum sensitivity by an after-mentioned formula ($\Theta=\cos-1\ (\Phi/d)$). As shown in FIG. 7(*b*), row-direction orientation control phase shifters 805*a*–805*c* respectively delay a shift of a high-frequency electric power passing by the phase shift $\Phi$. Supposing that intervals at which respective phase shifters 805 are arranged are distance d, a high-frequency electric power input into the antenna patch 804*a* in the first row is supplied to a connection node N1 without a phase shift. Meanwhile, a high-frequency electric power input into the antenna patch 804*b* in the first row has its phase delayed by the phase shift $\Phi$ by the phase shifter 805*a* and is supplied to the connection node N1, a high-frequency electric power inputted into the antenna patch 804*c* in a first row has its phase delayed by the phase shift $2\Phi$ by the phase shifters 805*a* and 805*b* and is supplied to the connection node N1, and a high-frequency electric power input into the antenna patch 804*d* in the first row has its phase delayed by the phase shift $3\Phi$ by the phase shifters 805*a,* 805*b,* and 805*c* and is supplied to the connection node N1.

In other words, the direction D at a prescribed angle $\Theta$ ($\Theta=\cos-1\ (\Phi/d)$) with respect to the arrangement direction of the antenna patches 804*a*–804*d* in the first row becomes the maximum sensitivity direction of the received electric wave by the antenna patches 804*a*–804*d* in the first row. Further, w1–w3 in the figure denote wave surfaces of the received signal of identical phase.

Also, the orientation characteristics by antenna patches in other rows, that is, the second to the fourth rows are precisely identical to the above-described orientation characteristics by the antenna patches in the first row.

Therefore, when a row-direction orientation control voltage 810 is changed, the phase shift $\Phi$ by the phase shifters 805*a*–805*l* is successively changed, whereby the angle $\Theta$ between the maximum sensitivity direction and the row direction changes in a surface vertical to the column direction.

On the other hand, a high-frequency electric power supplied to the connection node N4 corresponding to the fourth column is supplied to the feeding terminal 807 without causing a change in its phase.

A high-frequency electric power supplied to the connection node N3 corresponding to the third column has its phase delayed by the phase shift $\Phi$ by the phase shifter 806*c,* and is supplied to the feeding terminal 807.

A high-frequency electric power supplied to the connection node N2 corresponding to the second column has its phase delayed by the phase shift $2\Phi$ by the phase shifters 806*b* and 806*c,* and is supplied to the feeding terminal 807.

A high-frequency electric power supplied to the connection node N1 corresponding to the first column has its phase delayed by the phase shift $3\Phi$ by the phase shifters 806*a,* 806*b,* and 806*c,* and is supplied to the feeding terminal 807.

Therefore, when a row-direction orientation control voltage 811 is changed, the phase shift $\Phi$ by the phase shifters 806*a*–806*c* is successively changed, whereby the angle between the maximum sensitivity direction and the column direction changes in a surface vertical to the column direction.

As described above, according to the present invention, it is possible to realize an antenna which enables wide variation of orientation characteristics by employing a phase shifter using ferroelectrics and ferromagnetic materials, to decrease performance degradation due to accuracy variation at the assembly by molding functional elements of an antenna control integrally, has many kinds, is capable of changing orientation characteristics continuously with a simple structure, and is low in cost.

Embodiment 5

An active phased array antenna employing a grounded conductor subjected to drawing will be described with reference to a figure as a fifth embodiment.

Since a feeding line employed for an active phased array antenna generally has a different line impedance required for each part, a linear conductor having a different sectional shape for each feeding line is employed as a strip conductor, thereby changing the distance between the strip conductor and the grounded conductor. That is, it is utilized that the line impedance is different when the distance between the strip conductor and the grounded conductor is different.

However, there occurs a need to employ plural kinds of strip conductors in this method, and thus, a manufacturing process of an active phased array antenna becomes complicated, resulting in variation occurring in its performance.

This embodiment solves the above-described problem by subjecting the grounded conductor to drawing.

Figure 8:
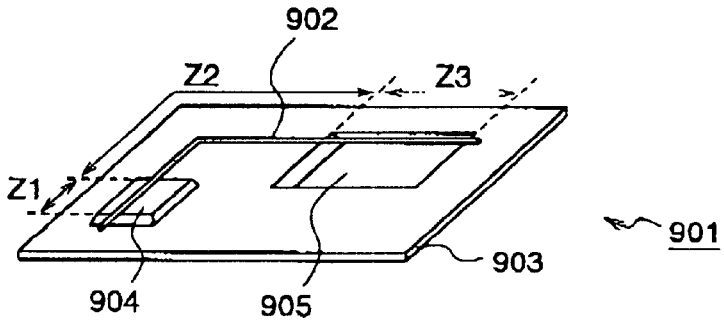
FIG. 8 is a perspective view for explaining the relation of a grounded conductor and a strip conductor in an active phased array antenna according to a fifth embodiment.

FIG. 8 is an expanded perspective view illustrating a part 901 of an active phased array antenna with its grounded conductor subjected to drawing.

In FIG. 8, numeral 902 denotes a strip conductor, numeral 903 denotes a grounded conductor, numeral 904 denotes a part of convex drawing, and numeral 905 denotes a part of concave drawing.

That is, the active phased array antenna according to the present invention comprises the grounded conductor 903 being provided with the convex draw 904 and the concave draw 905, and the strip conductor 902 as a feeding line as shown in FIG. 8.

It is a preferable mode to constitute the strip conductor 902 with a linear conductor having wholly identical sectional shape.

That is, even when the strip conductor 902 is a linear conductor having wholly identical sectional shape, the distance between the strip conductor and the grounded conductor is different due to the convex drawing part 904 and the concave drawing part 905 provided in the grounded conductor 903 at each part of the feeding line, whereby line impedances Z1, Z2, and Z3 can be obtained being different for respective lines even when a linear conductor having different sectional shape for each line is not employed, as shown in the figure.

Therefore, according to the feeding line in the present invention, a linear conductor having wholly identical sectional shape can be employed, thereby realizing a low-cost active phased array antenna.

Further, it is also possible that since the strip conductor 902 uses a linear conductor having wholly identical sectional shape, a linear conductor which has different length for each linear part of the feeding line, for example, is prepared, this is fixed at a specified position, and a contact point of linear conductors which corresponds to a flection part of the feeding line is connected by soldering or the like, thereby to realize the whole feeding line.

Thereby, it is not required to use conductor materials for feeding line of complicated shape, and therefore, distortion defect of materials at the transportation or the handling of conductor materials for feeding line can be avoided in a production department, resulting in a further low-cost active phased array antenna.

Embodiment 6

An active phased array antenna 906 will be described with reference to a figure as a sixth embodiment, in which a lamination formed by laminating a supporting dielectric material, a grounded conductor, and a strip conductor for feeding, and the antenna controlling apparatus as described in the third embodiment are molded by an integral molding using ceramics.

Figure 9:
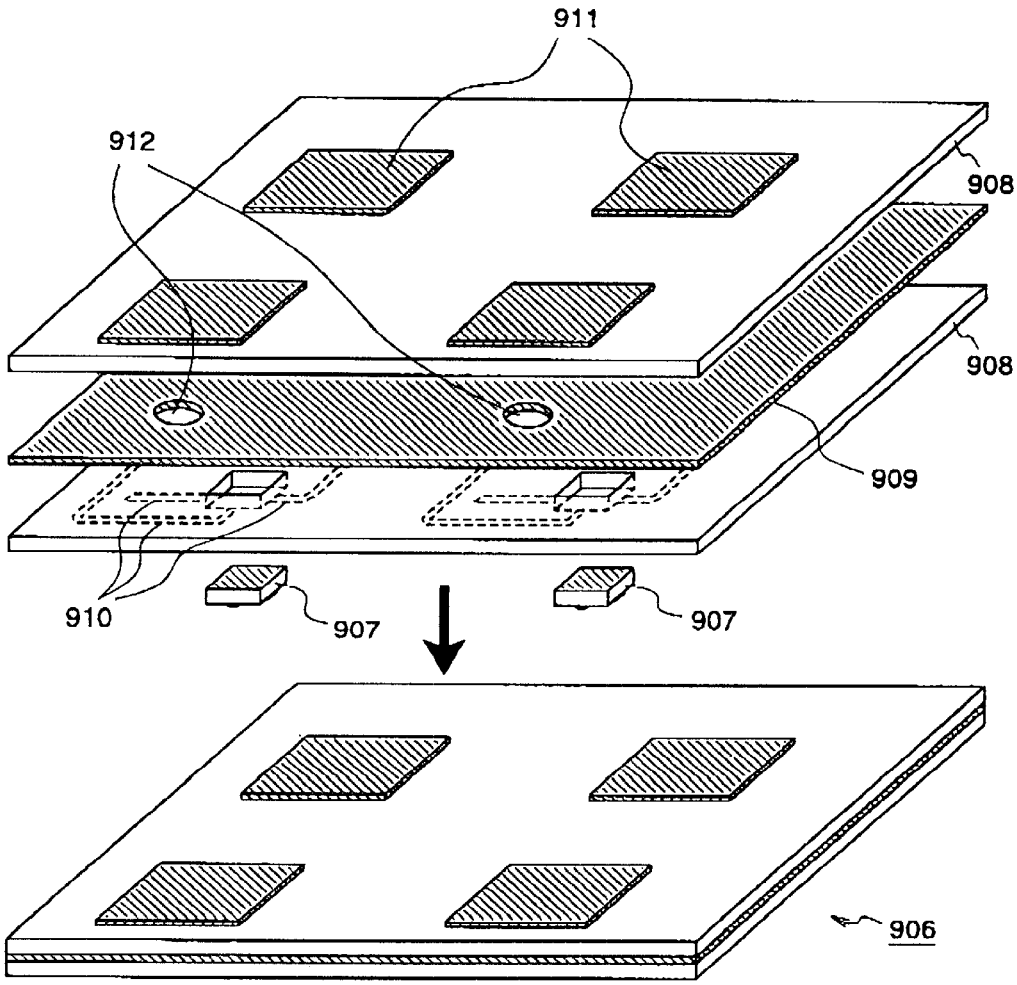
FIG. 9 is a perspective view illustrating an active phased array antenna according to a sixth embodiment.
Figure 10A:
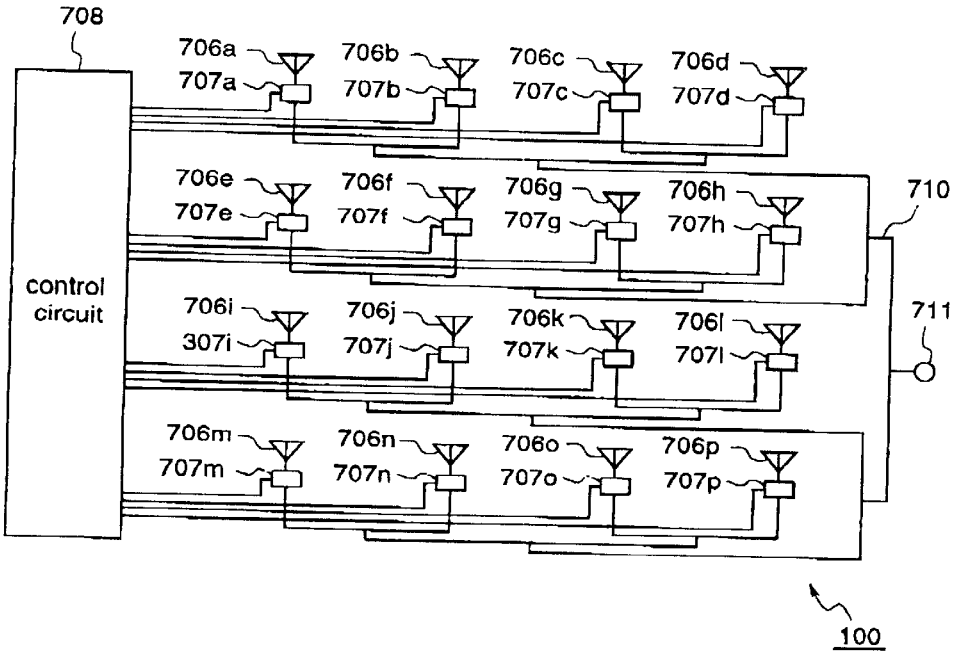
FIG. 10(*a*) is a block diagram illustrating the structure of a conventional active phased array antenna, and FIG. 10(*b*) is a block diagram illustrating the structure of a phase shifter employed for the conventional active phased array antenna.
Figure 10B:
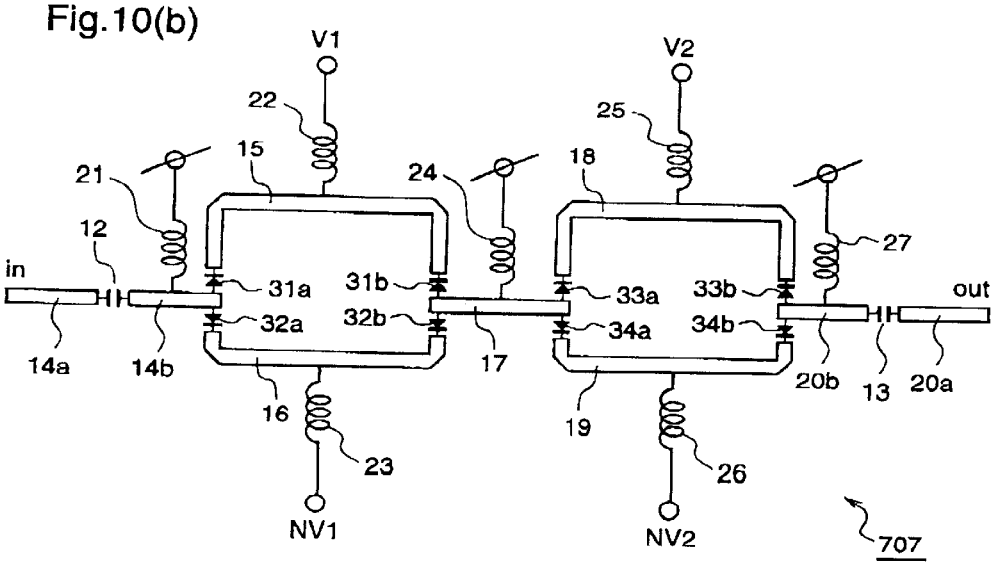

FIG. 9 is an exploded perspective view for explaining the active phased array antenna 906 according to the sixth embodiment. In FIG. 9, numeral 907 denotes an antenna controlling apparatus, numeral 908 denotes a supporting dielectric material, numeral 909 denotes a grounded conductor, numeral 910 denotes a strip conductor for feeding, numeral 911 denotes an antenna patch, and numeral 912 denotes an antenna connection hole.

In this embodiment, a lamination is formed by laminating the supporting dielectric material 908, the grounded conductor 909, and the strip conductor for feeding 910 in the first place. Next, this lamination, the antenna controlling apparatus 907, and the antenna patch 911 are molded by the integral molding using ceramics.

With respect to the antenna controlling apparatus 907, that described in the third embodiment is used.

With the above-described construction, it is possible to perform all the processes of manufacturing active phased array antenna by a manufacturing process of ceramic multilayer base material.

That is, a manufacturing accuracy of each functional element required for an active phased array antenna and an accuracy of antenna assembly can all meet an operating accuracy required by the tens-micron in a present antenna manufacture in millimeter waveband, thereby realizing a manufacture of a high-performance active phased array antenna employed in millimeter waveband.

While a hybrid coupler is described as a branch line type in the above-described embodiment, others such as a ¼ wavelength distribution coupling type, a rat race type, or a phase inversion hybrid ring type, and further, a hybrid coil constituted by a microstrip or the like are also possible.

APPLICABILITY IN INDUSTRY

As described above, an active phased array antenna and an antenna controlling apparatus according to the present invention do not require a circuit configuration for switching many transmission lines and can simplify a circuit configuration or wiring constituting a phase shifter, whereby they are significantly available as a low-cost active phased array antenna and an antenna controlling apparatus which are of simpler structure and capable of continuously changing antenna orientation characteristics.

What is claimed is:

1. An active phased array antenna which has a structure in which plural antenna patches and a feeding terminal for applying a high-frequency electric power to a dielectric base material are provided on the dielectric base material, the respective antenna patches and the feeding terminal are connected by feeding lines branching off from the feeding terminal, and a phase shifter which can electrically change the phase of a high-frequency signal passing on the respective feeding lines are arranged to constitute a part of the feeding lines;

said phase shifter comprising a microstrip hybrid coupler, which employs paraelectrics as base material and a microstrip stab which employs ferroelectrics as base material and which is electrically connected to the microstrip hybrid coupler; and a dc control voltage being applied to the microstrip stab to change the passing phase shift quantity.

2. The active phased array antenna as defined in claim 1, wherein the plural antenna patches are arranged in matrix at equal intervals in the row and column directions respectively, the phase shifters are arranged so that the number of the phase shifters inserted between each antenna patch in each row and the feeding terminal is larger by one sequentially than the number of the phase shifters inserted between each antenna patch in adjacent row and the feeding terminal, and so that the number of the phase shifters inserted between each antenna patch in each column and the feeding terminal is larger by one sequentially than the number of the phase shifters inserted between each antenna patch in adjacent column and the feeding terminal, and all the phase shifters have the same characteristics in the row and column directions respectively.

3. The active phased array antenna as defined in claim 1, wherein the active phased array antenna is constructed by laminating seven layers;

said seven layers comprising a first layer, a second layer, . . . , a seventh layer sequentially from the top layer; the first, third, fifth, and seventh layer comprising dielectric materials, while the second, fourth, and sixth layer comprising conductor, the active phased array antenna has a first microstrip structure comprising the first, second, third, and fourth layer, and a second microstrip structure comprising the fourth, fifth, sixth, and seventh layer;

said first microstrip structure and second microstrip structure sharing the fourth layer as a grounded layer, and the antenna patch is provided in the second layer, the feeding line and the phase shifter are provided in the sixth layer, air is employed in the third layer, and a combination of air and the ferroelectrics is employed in the fifth layer.

4. The active phased array antenna as defined in claim 1, wherein an antenna controlling apparatus is provided.

5. The active phased array antenna as defined in claim 1, wherein the grounded conductor is subjected to drawing.

6. The active phased array antenna as defined in claim 5, wherein all the feeding lines are provided with a strip conductor comprising a linear conductor having identical sectional shape.

7. The active phased array antenna as defined in claim 1, wherein a supporting dielectric material, the grounded conductor, and the strip conductor for feeding are laminated to form the lamination, and this lamination and an antenna controlling apparatus are molded by an integral molding using ceramics.

8. An active phased array antenna being provided with a phase shifter which comprises at least an open end stab having ferroelectrics and ferromagnetic materials as base materials, and a microstrip hybrid coupler having paraelectrics as base materials.

9. The active phased array antenna as defined in claim 8, wherein the open end stab is constituted by laminating a grounded conductor, the ferroelectric, a strip conductor, and the ferromagnetic materials, sequentially.

10. The active phased array antenna as defined in claim 8, wherein the open end stab is constituted by laminating the grounded conductor, the ferroelectric, the ferromagnetic materials, and the strip conductor;

said ferroelectrics and said ferromagnetic materials being laminated between said grounded conductor and said strip conductor in a surface direction parallel to the grounded conductor surface.

11. An antenna controlling apparatus being molded employing ferroelectrics, ferromagnetic materials, paraelectrics, and electrode materials by an integral molding using ceramics;

said antenna controlling apparatus being provided with a function of a phase shifter.

12. An active phased array antenna comprising a row-column array antenna wherein row array antennas, in each of which antenna patches and phase shifters are connected alternately serially, are connected with phase shifters alternately in series, in which there is provided an antenna controlling apparatus as defined in claim 11.

13. An antenna controlling apparatus being molded employing ferroelectrics, ferromagnetic materials, paraelectrics, and electrode materials by an integral molding using ceramics;

said antenna controlling apparatus being provided with functions of a phase shifter and a dc blocking element.

14. An antenna controlling apparatus being molded employing ferroelectrics, ferromagnetic materials, paraelectrics, and electrode materials by an integral molding using ceramics;

said antenna controlling apparatus being provided with functions of a phase shifter, a dc blocking element, and a high-frequency blocking element.

15. An antenna controlling apparatus being molded employing ferroelectrics, ferromagnetic materials, paraelectrics, and electrode materials by an integral molding using ceramics;

said antenna controlling apparatus being provided with functions of a phase shifter, a dc blocking element, a high-frequency blocking element, and an antenna patch.

* * * * *